US005993570A

United States Patent [19]

Gray

[11] Patent Number: 5,993,570

[45] Date of Patent: Nov. 30, 1999

[54] LINEPIPE AND STRUCTURAL STEEL PRODUCED BY HIGH SPEED CONTINUOUS CASTING

[75] Inventor: John Malcolm Gray, Houston, Tex.

[73] Assignee: American Cast Iron Pipe Company, Birmingham, Ala.

[21] Appl. No.: 08/879,331

[22] Filed: Jun. 20, 1997

[51] Int. Cl.[6] ..... C22C 38/04; C22C 38/12

[52] U.S. Cl. ..... 148/320; 148/909; 420/126; 420/127

[58] Field of Search ..... 148/320, 909; 420/126, 127

[56] References Cited

U.S. PATENT DOCUMENTS

| | | | |
|---|---|---|---|
| 4,153,454 | 5/1979 | Emi et al. . | |
| 4,388,122 | 6/1983 | Sudo et al. | 148/320 |
| 4,388,123 | 6/1983 | Murayama . | |
| 4,453,986 | 6/1984 | Sponseller et al. . | |
| 4,533,405 | 8/1985 | Sponseller et al. . | |
| 4,631,095 | 12/1986 | von Hagen et al. . | |
| 5,147,474 | 9/1992 | Tamehiro et al. | 148/320 |
| 5,567,250 | 10/1996 | Akamatsu et al. . | |

FOREIGN PATENT DOCUMENTS 2 535 343 4/1984 France .

OTHER PUBLICATIONS

Patent Abstracts of Japan, vol. 18, No. 344 (C–1218) Jun. 29, 1994 and JP 06 081034A (Sumitomo Metal Ind. Ltd.), Mar. 22, 1994.

Patent Abstracts of Japan vol. 95, No. 6, Jul. 31, 1995 and JP 07 070697 A (Sumitomo Metal Ind. Ltd.), Mar. 14, 1995.

Patent Abstracts of Japan, vol. 15, No. 216 (C–0837), Jun. 4, 1991 and JP 03 064414 A (NKK Corp.), Mar. 19, 1991.

Patent Abstracts of Jpan, vol. 18, No. 591 (C–1272), Nov. 11, 1994 and JP 06 220577A (Kawasaki Steel Corp.), Aug. 9, 1994.

Patent Abstracts of Japan, vol. 15, No. 27 (C–0797), Jan. 22, 1991 and JP 02 267241A (Kawasaki Steel Corp.), Nov. 1, 1990.

T.U.F. Pipe, "Technical Data of Sour Service ERW Line Pipe" Apr. 1992, Nippon Steel Corporation, pp. 8/35–35/35.

Technical Bulletin, "HIC and SSC Resistance of Line Pipes For Sour Gas Service" Nippon Kokan Technical Report, No. 31 (1981), pp. 1–12 Tadaaki Taira, Koshiro Tsukaka, Yasuo Kobayashi, Masayuki Tanimura, Hirosuke Inagaki and Nobuhiro Seki.

"Development of Low PCM X70 Grade Line Pipe For Prevention of Cracking At Girth Welding", Dec. 19, 1983, pp. 1–9, H. Hashimoto, Y. Komizo, K. Bessyo, Y. Yamaguchi and T. Yamura.

"Development of Low $P_{CM}$ High Grade Line Pipe for Arctic Service and Sour Environment", dated Dec. 19, 1983, pp. 1–12, H. Ohtani, T. Hashimoto Y. Komizo, J. Murayama, K. Bessyo, T. Sawamura, and T. Kyogoku.

8306–030, "HSLA Steels With Improved Hydrogen Sulfide Cracking Resistance", pp. 827–834, G.M. Pressouyre, R. Blondeau and L. Cadiou, Oct. 1983.

8306–032, "Influence of Metallurgical Factors on HIC of High Strength ERW Line Pipe For Sour Gas Service", pp. 835–842, K. Yamada, H. Murayama, Y. Satoh, Z. Chano, N. Tanaka and K. Itoh, Oct. 1983.

*Primary Examiner*—Deborah Yee
*Attorney, Agent, or Firm*—Kerkam, Stowell, Kondracki & Clarke, P.C.; John C. Kerins

[57] ABSTRACT

A high strength, high toughness, low carbon/low manganese steel is provided that is further resistant to stepwise cracking and sulfide stress cracking. The steel can be produced by conventional or thin slab casting techniques using normal speeds, with low manganese segregation levels. The steels are excellent candidates for linepipe applications in severe sour gas service.

23 Claims, 1 Drawing Sheet

Stepwise cracking as a function of pipe yield strength and manganese content.

Stepwise cracking as a function of pipe yield strength and manganese content.

LINEPIPE AND STRUCTURAL STEEL PRODUCED BY HIGH SPEED CONTINUOUS CASTING

BACKGROUND OF THE INVENTION

1. Field of the Invention

The present invention is directed to a high-strength linepipe and structural steel that is resistant to hydrogen-induced cracking (HIC) in sour service.

2. Description of Related Art

A continuing need exists to develop steels having high strength which can provide extended service life as linepipe in sour gas ($H_2S$) service. High strength linepipe for this sour service has heretofore been produced from low carbon-manganese steel, and strengthened by the addition of niobium and/or vanadium. Manganese levels for such steels have typically been in the range of 0.90 to 1.20 weight percent, when it is expected that the linepipe will be used in the most severe service conditions. For the purposes of this disclosure, manganese levels in the aforesaid range of 0.90–1.20 weight percent will be referred to as being "relatively high" manganese contents for low carbon-manganese steels.

While providing resistance to cracking due to exposure to sour gas, these steels are prone to manganese sulfide stringer formation, due to the relatively high level of manganese employed in the steel. This is the case even where the steel has very low sulfur levels (<0.003 wt. percent), because the Mn:S ratio is very high (>40,000:1). In order to combat this tendency to form manganese sulfide stringers, the inclusion of calcium, which causes preferential formation of globular or angular calcium oxysulfide inclusions, has become the standard practice. Rare earth metals have also shown the ability to reduce the tendency of the steel to form manganese sulfide stringers. However, both calcium and rare earth additions are expensive and can give rise to processing difficulties such as generation of excessive fumes, nozzle blocking or poor cleanliness ratings.

In casting linepipe steel, from a processing standpoint, steels having manganese contents above 1.0 weight percent are also prone to centerline segregation when casting speeds are high. Further, centerline segregation can occur when proper superheats are not maintained and/or when machine maintenance and water cooling practices are poor.

It is therefore a principal object of the present invention to provide a high strength steel which is suitable for extended use in wet, sour gas service.

It is a further principal object of the present invention to provide a high strength steel having a very low manganese content, yet which is resistant to sour gas ($H_2S$) degradation.

It is an additional important object of the present invention to provide a high strength steel composition, suitable for sour gas service, which can be continuously cast at the high, normally desired, speeds employed in casting non-linepipe steel compositions.

It is a further important object of the present invention to provide a high strength steel composition that avoids the need to treat the alloy with calcium or rare earth metals in order to reduce the formation of manganese sulfide stringers.

It is an additional object of the present invention to provide a high strength, high toughness steel that is remarkably resistant to stepwise cracking and to sulfide stress cracking.

It is a further object of the present invention to provide a high-strength steel that has a very low carbon and manganese content as compared to high strength steels currently used in sour gas service.

SUMMARY OF THE INVENTION

The above and other important objects of the present invention are accomplished by providing a steel composition that produces a high strength, high toughness steel that is resistant to attack in even the most severe sour gas or wet sour gas service. Notably, it has been found that a steel that does not rely on a high manganese content to provide the high strength levels, but rather relies on niobium and, optionally, vanadium and/or other alloying elements to provide the necessary mechanisms to achieve high strength in the steel, will avoid may of the aforenoted problems in sour-gas service experienced with the previously used high strength steels having higher manganese contents.

Steel compositions falling within the ranges set forth below have been demonstrated to provide high strength and toughness characteristics, and have demonstrated an ability to withstand stepwise cracking and sulfide stress cracking, such that they will be highly suitable for use in severe sour gas service, and particularly as linepipe used in sour gas service.

TABLE I

| Element | Range (wt. %) |
|---|---|
| C | 0.015–0.080 |
| Mn | 0.10–1.0 |
| Nb (Cb) | 0.005–0.15 |
| Ti | 0.005–0.030 |
| Cr | ≦0.50 |
| Ni | ≦0.95 |
| Mo | ≦0.60 |
| B | ≦0.0025 |
| S | ≦0.008 |
| N | 0.001–0.010 |
| Ca | ≦0.0050 |
| P | ≦0.025 |

With such steel compositions, high yield strengths in the range of 36–80 ksi and high ultimate tensile strengths in the range of 45–90 ksi can be achieved. In addition, steels within the above ranges demonstrate excellent impact strengths (high energy impact valves) and Charpy V-notch transition temperatures.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments taken in conjunction with the accompanying drawings.

DETAILED DESCRIPTION OF THE PREFERRED EMBODIMENT

Figure 1:
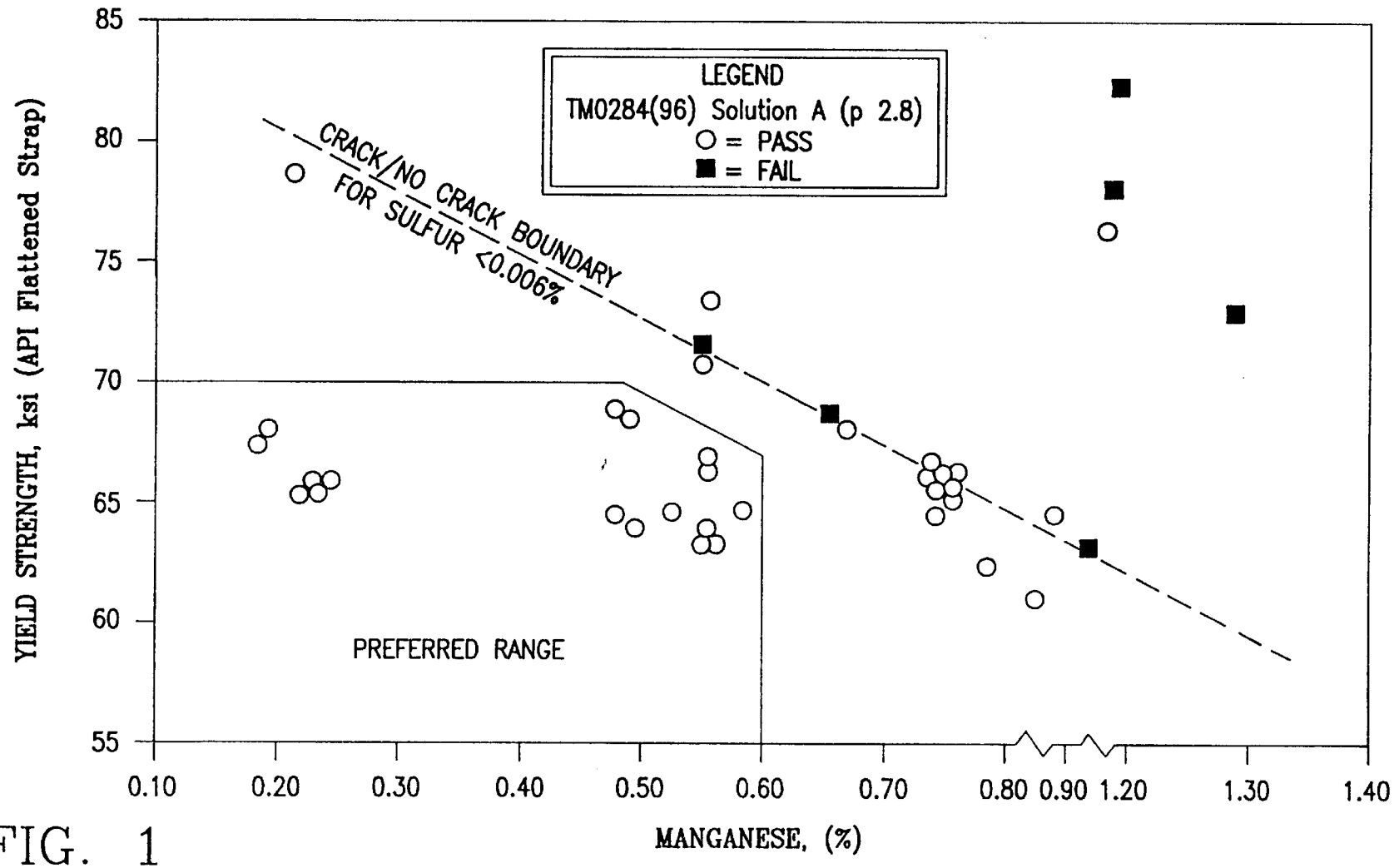
FIG. 1 is a graph depicting the results of a NACE TM0284-96 stepwise cracking test, plotting the weight percent of manganese against the yield strengths of the samples.

In a preferred embodiment of the present invention, a composition that yields a high-strength, high toughness steel, without relying on the use of a relatively high manganese content to provide the relatively high strength characteristics, is provided. The manganese content in the steels according to the present invention can be very low, such as 0.15 weight percent or less, thereby virtually eliminating manganese segregation and the tendency of the steel to form manganese sulfide. Further, the low manganese-to-sulfur ratio present in the steels, which is preferably approximately 3,000:1 to 5,000:1, minimizes the tendency of any MnS that may be formed, to form into stringers.

The steel of the present invention relies on the addition of niobium to provide the high strength characteristics, and, optionally, any one or more of vanadium, molybdenum, chromium, boron, copper and nickel, used in combination with the niobium. These elements combine to lower the austenite-to-ferrite ($\gamma \rightarrow \alpha$) transformation temperature and to prevent the formation of coarse ferrite grains at the very low manganese and carbon levels employed in the steel. The benefits derived from these strengthening mechanisms are enhanced or maximized by water cooling the steel after the strip or plate rolling.

The steel can be more consistently produced due to the reliance on niobium, and optionally also vanadium, precipitation hardening, and on control of the austenite to ferrite transformation temperature. The normally-experienced variations in mechanical properties in coiled product resulting from coiling temperature variations and head-to-tail (leading end to trailing end) temperature variations are minimized or eliminated by the strengthening elements (principally niobium) and mechanisms used in producing this steel.

The steel of the present invention can be treated with calcium or rare earth metals for sulfide inclusion shape control, as in conventional practice. However, the use of titanium reduces manganese sulfide plasticity, especially at low manganese and nitrogen contents, and when the manganese-to-sulfur ratio is very low, which are both features of the steel of the present invention.

The very-low carbon and manganese contents in the steel maximize delta ($\delta$) ferrite formation during solidification and facilitate solute redistribution. Tolerance for phosphorous impurity is increased and there is a virtual absence of pearlite banding. The steels can be rolled on plate mills or strip mills using either direct hot charging or conventional reheating practices.

Steels having the above characteristics can be obtained within the following preferred compositional ranges:

TABLE II

| Element | Range (wt. %) |
|---|---|
| C | 0.015–0.080 |
| Mn | 0.10–1.0 |
| Nb (Cb) | 0.005–0.15 |
| Ti | 0.005–0.030 |
| Cr | ≦0.50 |
| Ni | ≦0.95 |
| Mo | ≦0.60 |
| B | ≦0.0025 |
| S | ≦0.008 |
| N | 0.001–0.010 |
| Ca | ≦0.0050 |
| P | ≦0.025 |

Within this overall range, an especially preferred compositional range is as follows:

TABLE III

| Element | Range (wt. %) |
|---|---|
| C | 0.015–0.050 |
| Mn | 0.10–0.55 |
| Nb (Cb) | 0.03–0.09 |
| Ti | 0.015–0.025 |
| Cr | — |
| Ni | — |
| Mo | ≦0.10 |
| B | ≦0.009 |
| S | ≦0.003 |
| N | 0.001–0.005 |
| Ca | ≦0.0025 |
| P | ≦0.008 |

Steels having compositions within the ranges set forth above can be cast at high casting speeds, in the range of 0.8 to 3.0 m/min, that are desired for production efficiency, by conventional (200 to 300 mm thick) or thin (50–90 mm thick) slab caster. The steels cast at such high speeds exhibit low segregation intensity, and, as noted previously, high strength, high toughness, and resistance to degradation or failure in sour service applications.

In addition to the aforenoted advantages in processing, the steels of the present invention have the notable advantage of providing excellent resistance to stepwise cracking and sulfide stress cracking even when calcium and/or copper are not employed in the steel. Further, the high strength properties can be obtained in the absence of molybdenum. When molybdenum is present within the stated range, the high strength and excellent resistance to stepwise cracking and sulfide stress corrosion cracking can be obtained in the absence of calcium.

In order to demonstrate the suitability of the steels of the present invention for use as linepipe in sour service, as well as to demonstrate the high strength and high toughness characteristics of the steels, several steels falling within the compositional ranges set forth in Table I above were subjected to tensile tests, impact tests, stepwise cracking (hydrogen-induced cracking or HIC) tests, and sulfide stress cracking tests. In particular, samples from four heats, denoted in Table IV below as A–D, were subjected to tensile testing, Charpy V-notch impact tests, drop weight tear tests and stepwise cracking tests. Samples from other heats, designated in Table IV below as E–G, were tested for resistance to sulfide stress cracking in accordance with the National Association of Corrosion Engineers (NACE) Standard TM0177. Samples from all of these heats, plus dozens of others having compositions falling within the compositional ranges of Tables II and III, were tested for resistance to hydrogen-induced cracking, or stepwise cracking, in accordance with NACE Standard TM0284-96. The results of those tests are discussed below, and with respect to FIG. 1.

TABLE IV

| Steel | C | Mn | P | S | Cb(Nb) | Si | Ti | Cu | Ni | Mo | Cr | V | Al | B | Ca | N |
|---|---|---|---|---|---|---|---|---|---|---|---|---|---|---|---|---|
| A | .046 | .230 | .005 | .004 | .054 | .210 | .013 | .250 | .130 | .000 | .020 | .007 | .063 | .000 | .002 | .004 |
| B | .032 | .220 | .006 | .004 | .052 | .200 | .021 | .250 | .130 | .011 | .020 | .007 | .039 | .000 | .000 | .004 |
| C | .045 | .190 | .005 | .004 | .048 | .160 | .011 | .000 | .010 | .240 | .020 | .007 | .047 | .000 | .001 | .005 |
| D | .052 | .220 | .007 | .004 | .051 | .200 | .020 | .250 | .130 | .230 | .020 | .007 | .044 | .000 | .000 | .004 |
| E | .043 | .741 | .015 | .003 | .022 | | .001 | .009 | .020 | .000 | | .000 | .028 | | .002 | |
| F | .046 | .734 | .013 | .003 | .024 | | .002 | .009 | .019 | .001 | | .000 | .043 | | .004 | |
| G | .048 | .727 | .015 | .003 | .024 | | .003 | .008 | .019 | .000 | | .000 | .032 | | .004 | |

Table V presents the results of the Charpy V-notch impact tests conducted on samples prepared from steel heats A–D, with the samples being ⅔ of the standard specimen size. As can be seen in the table, the fracture energies are quite high, even at sub-zero (°F.) temperatures, with Steel Heat B demonstrating remarkable impact resistance down to −80° F.

TABLE V

| | CHARPY V-notch Energy | | | | | | | | | | | | | Size: ⅔ |
|---|---|---|---|---|---|---|---|---|---|---|---|---|---|---|
| | Energy Average (ft-lbs) | | | | | | | Shear Area Average (%) | | | | | | |
| | 72° F. | 32° F. | 0° F. | −20° F. | −40° F. | −60° F. | −80° F. | 72° F. | 32° F. | 0° F. | −20° F. | −40° F. | −60° F. | −80° F. |
| Steel A | | 158 | 128 | 142 | 101 | 108 | 76 | | 100 | 100 | 100 | 84 | 86 | 67 |
| Steel B | | 182 | 181 | 184 | 184 | 181 | 177 | | 100 | 100 | 100 | 100 | 100 | 100 |
| Steel C | | 161 | 144 | 130 | 118 | 92 | 9 | | 100 | 100 | 100 | 100 | 76 | 8 |
| Steel D | | 151 | 133 | 129 | 130 | 69 | 67 | | 100 | 100 | 100 | 92 | 46 | 40 |

Table VI below presents data from a drop weight tear test, as well as the 50% and 85% values for brittle/ductile fracture transition temperatures as demonstrated in the Charpy V-notch impact tests and in the drop weight tear tests (DWTT). Again, the steels demonstrate excellent toughness characteristics with the steel of Heat B demonstrating truly outstanding results.

TABLE VI

| | DROP WEIGHT TEAR TEST | | | | | | | TRANSITION TEMPERATURE | | | |
|---|---|---|---|---|---|---|---|---|---|---|---|
| | Shear Area Average (%) | | | | | | | Charpy | | DWTT | |
| | 72° F. | 32° F. | 0° F. | −20° F. | −40° F. | −60° F. | −80° F. | 50% | 85% | 50% | 85% |
| Steel A | | 100 | 100 | 31 | 21 | | | <−80 | −56 | −14 | −4 |
| Steel B | | 100 | 100 | 100 | 100 | 100 | 28 | <−80 | <−80 | −75 | −65 |
| Steel C | | 100 | 100 | 27 | 18 | | | −68 | −56 | −14 | −4 |
| Steel D | | 100 | 58 | 27 | 18 | | | −58 | −43 | −5 | 19 |

The yield strengths and ultimate tensile strengths of tensile specimens from heats A–D, as well as from heats E–G, are reported in Table VII below. In general, for the linepipe applications to which this steel is directed, the desired range for yield strength is about 36–80 ksi, and the desired range of ultimate tensile strengths is 45–90 ksi. These would be considered as high-strength steels, as the term "high strength" is used herein. Since the higher strength steels can be more susceptible to hydrogen-induced cracking, a more preferred range of yield strengths is about 36–70 ksi, and a more preferred range of ultimate tensile strengths is 45–75 ksi. As can be seen, most of steels A–G fall within the preferred range.

TABLE VII

| STEEL | Yield Strength (ksi) | Ultimate Tensile Strength (ksi) |
|---|---|---|
| A | 66 | 73.0 |
| B | 66 | 71.5 |
| C | 68 | 72.5 |
| D | 79 | 85.5 |
| E | 65.5 | 71.0 |
| F | 66.5 | 72.5 |
| G | 64.5 | 71.5 |

Resistance to sulfide stress cracking is normally assessed, in accordance with the level of skill in the art, by the test methods set forth in NACE Standard TM0177. In the development of the present invention, tests were conducted on heats E–G in accordance with this NACE standard, modified to include a test period of 96 hours at 80% percent of the specified minimum yield strength (SMYS). No cracking was evidenced in these tests, indicating an acceptable level of resistance to sulfide stress cracking. It is notable that these heats tested for resistance to sulfide stress cracking had manganese contents toward the upper end of the range of manganese content desired for the present invention. It is expected that steels having lower manganese contents, in the more preferred range set forth in Table III above, will exhibit the same or even an improved level of resistance to sulfide stress cracking.

Samples from the above heats, as well as numerous other samples both within and outside of the compositional ranges set forth in Table I above were tested for resistance to hydrogen-induced cracking, or stepwise cracking, in accordance with NACE Standard TM0284-96, "Standard Test Method—Evaluation of Pipeline and Pressure Vessel Steels for Resistance to Hydrogen-Induced Cracking". FIG. 1 presents, in graphical form, a summary of the results of those tests, plotting the manganese content of the steels against their yield strength (in ksi). It can be seen from that graph that steels having higher manganese contents and steels having yield strengths approaching and exceeding 70 ksi are susceptible to stepwise cracking. This figure substantiates that the increased strength resulting from the use of higher levels of manganese comes at a price, namely, the increased susceptibility to stepwise cracking.

Nearly all of the steel compositions tested under the NACE TM0284-96 standard had a sulfur content of <0.006 wt.%. Accordingly, it was possible to delineate a crack/no crack boundary 100 based on the test results, and specifically based upon the three failed samples having lower manganese contents and higher yield strengths and those having higher manganese contents with lower yield strengths. The steels of the present invention will thus generally be confined to those falling below the broken line drawn through the graph in FIG. 1.

Especially preferred compositions are those having a manganese content in the range of about 0.10–0.60 wt.% and having a yield strength in the range of about 55–70 ksi. Steels meeting those criteria fall within the shaded region of FIG. 1. Because steels having both 0.60 wt.% manganese and a yield strength of 70 ksi would fall close to the crack/no crack boundary 100, a more conservative set of criteria would include a decreasing maximum yield strength from 70 ksi to 68 ksi maximum as the manganese content increases from 0.50 wt.% to 0.60 wt.%.

It is to be noted that the results presented in FIG. 1 are based on tests conducted using the Solution A (pH 5.2) standard test solution defined in NACE TM 0284-96. Additional tests were conducted in accordance with the standard, but using the lower pH, more severely corrosive, Solution B defined in the standard. Samples from heats A–D, as well as four other samples falling within the steel composition of the present invention, were tested using Solution B in the NACE test, and all samples passed the test, demonstrating a complete absence of stepwise cracking, even under these more severely corrosive conditions.

The American Petroleum Institute (API) has promulgated specifications for tubular products, such as line pipe, that are to be used for oil and gas transmission, and that are to be used in other oil and gas service. In particular, API Specification 5LX is directed to high-strength welded or seamless steel line pipe for oil or gas transmission, a use for which the steel of the present invention is especially well suited.

API 5LX is hereby incorporated by reference in its entirety. Included in API 5LX are several material grades, such as X46, X52, X56, X60, X65 and X70. The numbers following the "X" in these designations are the minimum yield strengths (in ksi) for materials of the respective grades. Each material grade further has certain compositional requirements and tensile strength requirements.

The API 5LX material grades are specified when alloy steel pipe is to be used in gas or sour gas service. Steels of the present invention having compositions falling within the ranges set forth in Table I meet all compositional limitations set forth in API 5LX, and, as can be seen by the yield strength results set forth in Table VII, steels can be produced to meet the requirements of all grades up through the X70 grade. Accordingly, the steels made in accordance with the present invention can be used as line pipe virtually across the entire spectrum of the API 5LX linepipe specification. Further, with the demonstrated increased resistance to hydrogen-induced cracking over steels currently supplied under the 5LX specification, the steels of the present invention will be especially well suited for use as 5LX linepipe (e.g. X52) in instances where, in addition to the material grade specification, requirements for resistance to hydrogen-induced cracking are specified or imposed.

It can thus be seen that the low carbon/low manganese steels of the present invention possess the desirable properties for use in linepipe applications, especially in sour gas service. Because of its high strength and toughness, the steel is also well suited to being used as structural steel. However, the particular embodiments and compositions discussed above are for illustrative purposes, and the invention is not intended to be limited to specific examples. Modifications may become readily apparent to those of ordinary skill in the art upon reviewing the foregoing specification, without departing from the spirit and scope of the invention. Accordingly, reference should be made to the appended claims to determine the scope of the invention.

What is claimed is:

1. A high strength steel exhibiting a microstructure substantially free of coarse grained ferrite comprising:

carbon in a range of about 0.015–0.080 weight percent;

manganese in a range of about 0.10–1.0 weight percent;

sulfur in a range of about <0.008 weight percent wherein the high strength steel has a yield strength, in a hot-rolled condition in the range of about 36 ksi to about 80 ksi.

2. A high strength steel as recited in claim 1, further comprising:

manganese in a range of about 0.10–0.60 weight percent.

3. A high strength steel as recited in claim 2, further comprising:

a manganese content in a range of about 0.10–0.23 weight percent;

niobium in a range of about 0.005–0.15;

wherein the steel has a yield strength in a range of about 66–79 ksi, wherein the steel has a Charpy V-notch 50% FATT in a range from about −58° F. to <−80° F., and wherein the steel is resistant to $H_2S$ degradation.

4. A high strength steel as recited in claim 1, wherein the steel is resistant to stepwise cracking and to sulfide stress cracking, and wherein said steel is substantially free of calcium.

5. A high strength steel as recited in claim 1, wherein the steel is resistant to stepwise cracking and to sulfide stress cracking, and wherein said steel is substantially free of copper.

6. A high strength steel as recited in claim 1, said steel being substantially free of molybdenum.

7. A high strength steel as recited in claim 1, further comprising molybdenum in a range of about 0.0 to 0.60 weight percent.

8. A high strength steel as recited in claim 6, wherein said steel is resistant to stepwise cracking and to sulfide stress cracking, and wherein said steel is substantially free of calcium.

9. A high strength steel as recited in claim 1, wherein the manganese-to-sulfur ratio is in a range of about 3000:1 to 5000:1.

10. A high strength steel as recited in claim 1, further comprising:

nitrogen in a range of about 0.001–0.010 weight percent, and titanium in a range of about 0.005–0.030 weight percent, which elements, in combination with said manganese, reduce MnS plasticity in the steel.

11. A high strength steel exhibiting a microstructure substantially free of coarse grained ferrite comprising:

| Element | Range (wt. %) |
|---|---|
| C | 0.015–0.080 |
| Mn | 0.10–1.0 |
| Nb (Cb) | 0.005–0.15 |
| Ti | 0.005–0.030 |
| Cr | ≦0.50 |
| Ni | ≦0.95 |
| Mo | ≦0.60 |
| B | ≦0.0025 |
| S | ≦0.008 |
| N | 0.001–0.010 |
| Ca | ≦0.0050 |
| P | ≦0.025 |

12. A high strength steel as recited in claim 11, wherein the composition comprises:

| Element | Range (wt. %) |
|---|---|
| C | 0.015–0.050 |
| Mn | 0.10–0.55 |
| Nb (Cb) | 0.03–0.09 |
| Ti | 0.015–0.025 |
| Cr | — |
| Ni | — |
| Mo | ≦0.10 |
| B | ≦0.009 |
| S | ≦0.003 |
| N | 0.001–0.005 |
| Ca | ≦0.0025 |
| P | ≦0.008 |

13. A high strength steel as recited in claim 11, wherein said steel has a yield strength of from about 36 ksi to about 80 ksi.

14. A high strength steel as recited in claim 12, wherein said steel has a yield strength of from about 36 ksi to about 80 ksi.

15. A high strength steel as recited in claim 13, wherein said steel is continuously cast at normal casting speeds, in a range of about 0.8 to 3.0 m/min, and wherein said steel has low manganese segregation tendencies and resistance to stepwise cracking in an $H_2S$ environment.

16. A high strength steel as recited in claim 14, wherein said steel is continuously cast at normal casting speeds, in a range of about 0.8 to 3.0 m/min, and wherein said steel has low manganese segregation tendencies and resistance to stepwise cracking in an $H_2S$ environment.

17. A hydrogen-induced cracking (HIC) resistant linepipe steel comprising:

| Element | Range (wt. %) |
|---|---|
| C | 0.015–0.080 |
| Mn | 0.10–1.0 |
| Nb (Cb) | 0.005–0.15 |
| Ti | 0.005–0.030 |
| Cr | ≦0.50 |
| Ni | ≦0.95 |
| Mo | ≦0.60 |
| B | ≦0.0025 |
| S | ≦0.008 |
| N | 0.001–0.010 |
| Ca | ≦0.0050 |
| P | ≦0.025 |

18. An HIC resistant linepipe steel as recited in claim 17, wherein the composition comprises:

| Element | Range (wt. %) |
|---|---|
| C | 0.015–0.050 |
| Mn | 0.10–0.55 |
| Nb (Cb) | 0.03–0.09 |
| Ti | 0.015–0.025 |
| Cr | — |
| Ni | — |
| Mo | ≦0.10 |
| B | ≦0.009 |
| S | ≦0.003 |
| N | 0.001–0.005 |
| Ca | ≦0.0025 |
| P | ≦0.008 |

19. An HIC-resistant linepipe steel as recited in claim 17, wherein said steel has a yield strength of from about 36 ksi to about 80 ksi, and wherein said steel meets all requirements of API specification 5LX.

20. An HIC-resistant linepipe steel as recited in claim 18, wherein said steel has a yield strength of from about 36 ksi to about 80 ksi, and wherein said steel meets all requirements of API Specification 5LX.

21. A high strength steel comprising:

carbon in a range of about 0.015–0.080 weight percent;

manganese in a range of about 0.10–0.23 weight percent;

sulfur in a range of about ≦0.008 weight percent;

wherein the high strength steel has a yield strength in the range of about 36 ksi to about 80 ksi.

22. A high strength steel comprising:

carbon in a range of about 0.015–0.080 weight percent;

manganese in a range of about 0.10–1.0 weight percent;

sulfur in a range of ≦0.008 weight percent;

about 0.03–0.15 weight percent niobium (columbium);

wherein the high strength steel has a yield strength in the range of about 36 ksi to about 80 ksi.

23. A high strength steel comprising:

carbon in a range of about 0.015–0.080 weight percent;

sulfur in a range of about ≦0.008 weight percent;

wherein said steel is substantially free of molybdenum, and wherein said steel has a yield strength in the range of about 36 ksi to about 80 ksi.

* * * * *